United States Patent [19]

Lyons

[11] 4,238,070

[45] Dec. 9, 1980

[54] GIFT BOX RIBBON SLEEVE

[75] Inventor: Russell J. Lyons, Franklin Park, Ill.

[73] Assignee: Champion International Corporation, Stamford, Conn.

[21] Appl. No.: 84,885

[22] Filed: Oct. 15, 1979

[51] Int. Cl.[3] ..... B65D 65/06; B65D 65/12

[52] U.S. Cl. ..... 229/87 R; 229/8; 229/35; 229/16 R; 206/586; 206/453; 428/129; 428/133

[58] Field of Search ..... 229/16 A, 16 R, 35, 229/8, 87 R, 87 AP, DIG. 1; 206/586, 805; 150/52 R; 428/451, 453, 454; 429/124, 129, 133, 537

[56] References Cited

U.S. PATENT DOCUMENTS

| | | | |
|---|---|---|---|
| 1,285,429 | 11/1918 | Shelton | 229/87 R |
| 1,954,567 | 4/1934 | Harding | 206/453 |
| 2,033,526 | 3/1936 | Kinkemon | 229/87 R X |
| 2,106,276 | 1/1938 | Heineman | 229/87 R X |
| 2,414,670 | 1/1947 | Roby | 229/87 R |
| 2,542,815 | 2/1951 | Jubin | 229/35 X |
| 3,185,381 | 5/1965 | Fobiano et al. | 229/35 |
| 3,349,984 | 10/1967 | Halko, Jr. | 206/586 X |

FOREIGN PATENT DOCUMENTS

| | | | |
|---|---|---|---|
| 529085 | 6/1931 | Fed. Rep. of Germany | 206/451 |

*Primary Examiner*—Davis T. Moorhead
*Attorney, Agent, or Firm*—Evelyn M. Sommer

[57] ABSTRACT

A ribbon sleeve for boxes, especially gift boxes, comprising a sheet-material blank having an elongated strip portion provided at each end with a pair of lobes. First fold lines are provided at the junction of the lobes with the respective end of the blank. The fold lines intersect one another in a point which is adapted to be placed onto a respective corner of the box. Second fold lines are provided in each lobe spaced from and parallel to the respective first fold lines. This enables the lobes to be bent along the first fold lines to overlie the sides of the box and portions of the lobes to be bent underneath the box along the second fold lines. A slit is provided in one lobe of each pair and a tab on the other lobe of the pair and insertable into the slit to serve as a connecting means for the lobes.

7 Claims, 4 Drawing Figures

GIFT BOX RIBBON SLEEVE

BACKGROUND OF THE INVENTION

This invention relates to a ribbon sleeve for gift boxes, i.e., to a sleeve which is applied to gift boxes in replacement of—and for the same purpose as—a conventional ribbon.

When an item is to be presented to someone as a gift it is usually "gift-wrapped", i.e., placed into an especially attractive package. When this is being done in stores, such as at the gift-wrapping counter of a department store, the item is generally placed into a decorative box which is then wrapped about with a ribbon to further decorate it and also to hold it closed.

The application of the ribbon is relatively time-consuming and requires a certain amount of skill and dexterity. It would be desirable, therefore, to reduce the time required and also to make it possible for unskilled persons to perform this task.

SUMMARY OF THE INVENTION

Accordingly, it is an object of the present invention to overcome the prior-art disadvantages.

More particularly, it is an object to provide a ribbon sleeve for gift boxes which replaces conventional ribbons but performs their functions.

Another object is to provide such a ribbon sleeve which can be applied to a box in a very brief time without the exercise of any skill or dexterity.

A concomitant object is to provide such a ribbon sleeve which can be repeatedly attached to and detached from a box.

Still a further object is to provide a ribbon sleeve which holds the box closed to which it is attached.

An additional object is to provide such a ribbon sleeve which can be shipped and stored in flat condition.

Yet another object is to provide such a ribbon sleeve which can be graphically decorated in any desired manner, and which thus enhances the decorations of a gift box and can even be used with a plain box since it adds decoration thereto.

In keeping with these objects, and with still others which will become apparent hereafter, one feature of the invention resides in a ribbon sleeve for boxes, especially gift boxes, comprising a sheet-material blank having an elongated strip portion provided at each end with a pair of lobes, first fold lines at the junction of the lobes with the respective end, the fold lines intersecting one another in a point which is adapted to be placed onto a respective corner of a box to be provided with the sleeve, and a second fold line in each lobe spaced from and parallel to the respective first fold lines, so that the lobes can be bent along the first fold lines to overlie the sides of a box onto which the sleeve is placed, and portions of the lobes can be bent underneath the box along the second fold lines; and means for connecting the portions of the lobes of each pair to one another.

DESCRIPTION OF THE PREFERRED EMBODIMENTS

Figure 1:
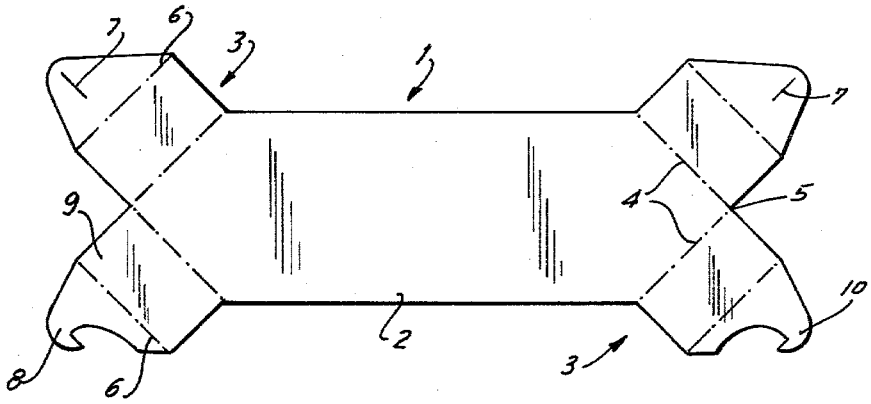
FIG. 1 is a plan view of a ribbon sleeve according to the invention in flat condition for shipping and storage.

The ribbon sleeve 1 according to the invention is shown in FIG. 1 in its flat condition, i.e., in the condition which it assumes when being shipped or stored. It is a cardboard or paperboard blank having a center portion 2 which has, at each end, two lobes 3. The material is so scored that fold lines 4 exist which meet one another in a point 5.

Spaced from and parallel to the respective fold line 4 each lobe is provided with another scored fold line 6. In addition, one lobe 3 of each pair at the respective end has a slit 7 and the other lobe of the same pair has a tab 8 which is insertable into the slit 7.

To use the sleeve 1, whose undecorated underside is shown in FIG. 1, the lobes 3 are folded upwards along lines 4. Thereupon the sleeve is inverted to expose its decorated upper side (FIG. 2) and placed onto a box B so that the points 5 each become located on one of a pair of diagonally opposite corners of the box. Of course, each differently-sized box requires an appropriately dimensioned ribbon sleeve, although a series of alternative score lines per sleeve could take care of a range of box sizes. The portions 9 (FIG. 1) of the lobes at this time extend along the outer edges of the box, at opposite sides of the respective corner. Now, the portions 10 of the lobes are folded against the underside of the box B along the fold lines 6 (FIG. 3) and each tab 8 inserted into the associated slit 7. The sleeve is now locked in place, holding the top B′ and bottom B″ of the box together without requiring anything further. The operation is very quick and requires no dexterity at all. Moreover, unlike the conventional ribbons, the sleeve according to the invention can be removed and re-applied repeatedly so that the purchaser may continue to enjoy the decorative appearance of the package even though he or she needs to repeatedly gain access to the interior of the box.

The exposed side of the sleeve can, of course, be provided with an almost unlimited variety of decorations (general purpose, specific purpose such as e.g., birthdays, or seasonal such as e.g., Christmas). In lieu of, or in addition to, such decorations the sleeve may also be provided with store names, brand names, instructions or the like.

Figure 2:
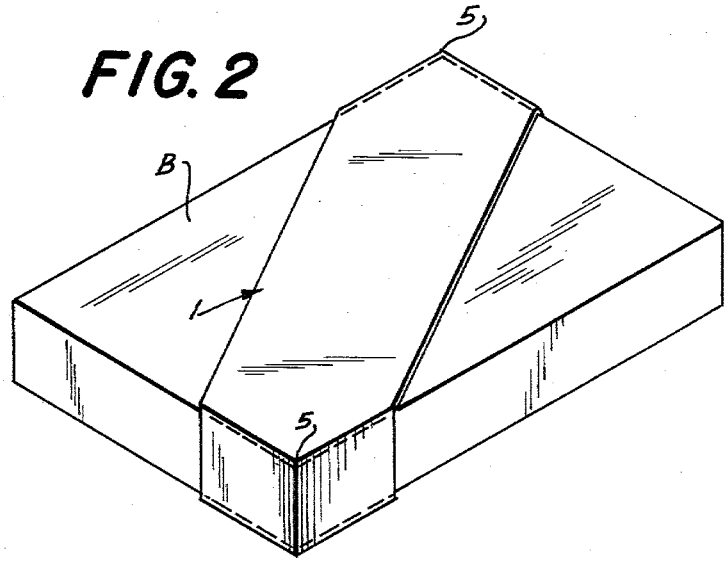
FIG. 2 is a top perspective, showing the sleeve attached to the upper side of a box.
Figure 3:
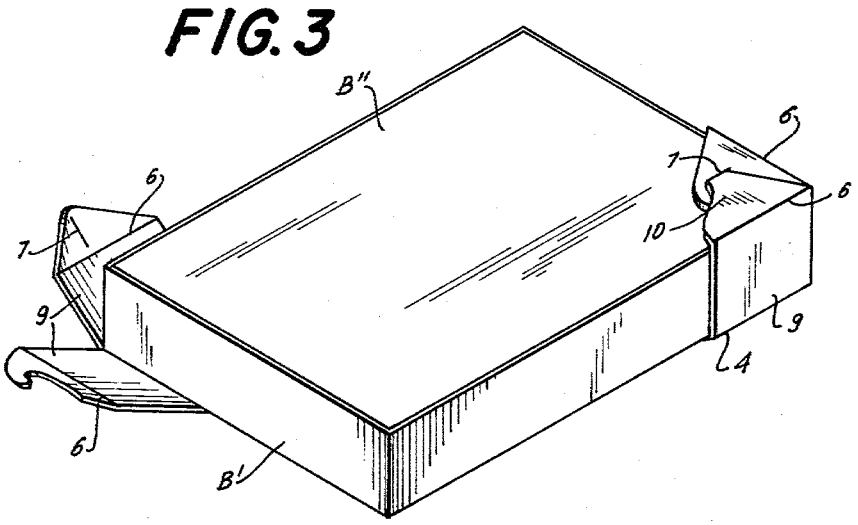
FIG. 3 is a bottom perspective, showing the underside of the box in FIG. 2 with the sleeve attached to it.
Figure 4:
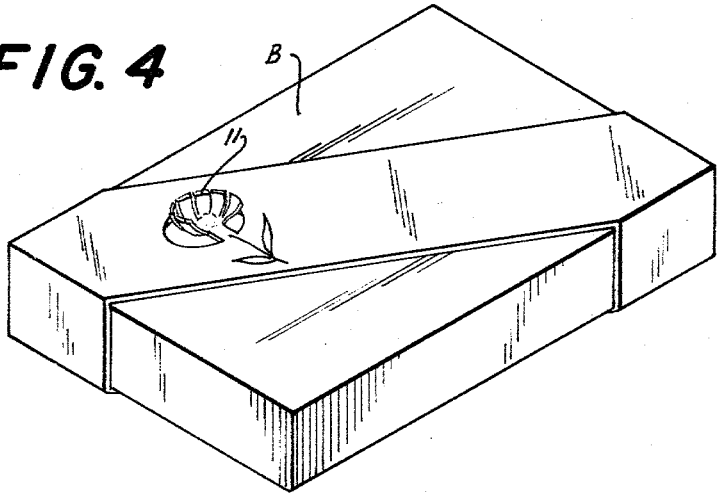
FIG. 4 is a front perspective, showing a modification of the sleeve.

The sleeve in FIG. 4 corresponds in all details to the one in FIGS. 1–3, except for showing that the sleeve may also be provided with one or more (one shown) three-dimensional decorations.

This is illustrated, by way of example, for a flower having its stem and leaves printed onto the sleeve, whereas the flower head 11 is partially stamped from the sleeve (a portion opposite the stem remains attached), so that it can be "popped up" to extend above the surface of the sleeve and give a three-dimensional effect. Naturally, these "pop-ups" are not limited to flowers; many other subjects are suitable and may be related e.g., to seasonal events or special customer requests.

While the invention has been illustrated and described as embodied in a ribbon sleeve for a gift box, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A ribbon sleeve for boxes, especially gift boxes, comprising a sheet-material blank having an elongated strip portion provided at each end with a pair of lobes, first fold lines at the junction of said lobes with the respective end, said fold lines intersecting one another in a point which is adapted to be placed onto a respective corner of a box to be provided with said sleeve, and a second fold line in each lobe spaced from and parallel to the respective first fold lines, so that the lobes can be bent along the first fold lines to overlie the sides of a box onto which the sleeve is placed and portions of the lobes can be bent underneath the box along the second fold lines; and means for connecting said portions of the lobes of each pair to one another.

2. A ribbon sleeve as defined in claim 1, wherein said blank is of paperboard.

3. A ribbon sleeve as defined in claim 1, wherein said blank has one major surface adapted to be placed against a box, and another major surface adapted to be provided with decorative and/or informative matter.

4. A ribbon sleeve as defined in claim 1, wherein said connecting means comprises a slit in one lobe of each pair, and a tab on the other lobe of the pair and insertable into the slit.

5. A ribbon sleeve as defined in claim 1; and further comprising decorative means on said elongated strip portion.

6. A ribbon sleeve as defined in claim 5, wherein said decorative means is at least one three-dimensional pop-up.

7. A ribbon sleeve as defined in claim 6, wherein said pop-up is a section of the strip portion which is in part severed from the remainder of the strip portion so that it can be erected by pushing it out of the plane of the strip portion.

* * * * *